United States Patent [19]

Swanson

[11] 4,092,079

[45] May 30, 1978

[54] CONNECTOR FOR USE IN A METHOD FOR REPLACING AN EXISTING UTILITY POLE WITHOUT DISTURBING HARDWARE MOUNTED THEREON

[75] Inventor: Harold V. Swanson, Morris Plains, N.J.

[73] Assignee: Interpace Corporation, Parsippany, N.J.

[21] Appl. No.: 636,914

[22] Filed: Dec. 2, 1975

[51] Int. Cl.[2] ..... F16B 7/04

[52] U.S. Cl. ..... 403/306; 52/296; 52/726

[58] Field of Search ..... 403/306, 305, 300, 301, 403/266, 268, 265, 267, 359; 61/53, 54; 174/45 R, 296; 52/726, 40, 514

[56] References Cited

U.S. PATENT DOCUMENTS

| | | | |
|---|---|---|---|
| 1,026,801 | 5/1912 | Haase | 52/40 |
| 1,555,847 | 10/1925 | Hudson | 403/306 |
| 1,785,587 | 12/1930 | Kuhlmann | 403/265 |
| 2,135,389 | 11/1938 | Dempsey | 52/726 X |
| 2,962,313 | 11/1960 | Conrad | 403/362 |
| 3,911,548 | 10/1975 | Perry | 52/40 |

FOREIGN PATENT DOCUMENTS

| | | | |
|---|---|---|---|
| 1,899 of | 1913 | United Kingdom | 403/268 |

*Primary Examiner*—Andrew V. Kundrat
*Attorney, Agent, or Firm*—Charles E. Baxley

[57] ABSTRACT

This disclosure teaches a connector for use in a method for replacing an existing utility pole (usually wood), without disturbing hardware mounted thereon. As taught in U.S. Pat. No. 3,911,548, the utility pole includes a proximal section having a bottom end attached to the earth and a distal section having hardware mounted thereon. A new pole section (preferably of prestressed concrete) is attached to the earth and has the connector mounted thereon. The distal section (with its hardware intact thereon) is severed from the proximal section. The distal section is then connected to project from the new pole section by inserting and securing the distal section in the connector. The connector includes an annular sleeve engageable about the outside of the new pole section. The sleeve projects beyond the new pole section and has push plates positioned within the sleeve to embrace the distal section to hold it socketed therein. The push plates are engaged by means of bolts anchored in the sleeve. A suitable sealant, such as grout, is also employed.

9 Claims, 9 Drawing Figures

CONNECTOR FOR USE IN A METHOD FOR REPLACING AN EXISTING UTILITY POLE WITHOUT DISTURBING HARDWARE MOUNTED THEREON

CROSS REFERENCE

This application relates to to copending U.S. Pat. application Ser. No. 606,073 filed Aug. 20, 1975, which is a continuation-in-part application with respect to also copending U.S. Pat. application Ser. No. 511,173 filed Oct. 2, 1974 which issued on Oct. 14, 1975 as U.S. Pat. No. 3,911,548. All of these applications and patent are owned by the same assignee, Interpace Corporation.

BACKGROUND OF THE INVENTION

As has been pointed out in U.S. Pat. No. 3,911,548, utility poles are subject to damage and deterioration, so it is desirable to provide for convenient replacement thereof.

Hardware connections to distal ends of utility poles represent expensive equipment and highly skilled workmanship, performed sometimes in hazardous conditions. Accordingly it is desirable to replace utility poles in such a way as to avoid necessity for reworking such hardware and to avoid interruptions of service resulting therefrom. Convenient and inexpensive means also have been desirable to alter the elevation and/or alignment of such hardware relative the earth.

Availability of materials for utility poles and economics relating thereto dictate frequently that a new pole be of a different material (such as wood, steel, aluminum, prestressed or reinforced concrete or resin bonded glass fibers) from that of the existing utility pole which is being replaced.

BRIEF STATEMENT OF INVENTION

The present invention solves the stated problems and other problems of the prior art in a useful, novel, unobvious and particularly facile way. A connector is presented for use in a method for replacing an existing utility pole, without disturbing hardware mounted thereon. In this method the utility pole comprises a proximal section having a bottom end attached to the earth and a distal section having hardware thereon. A new pole section is attached to the earth. The distal section of the existing pole (with the hardware intact thereon) is severed from the proximal section of the existing pole. The distal section is then connected to project from the new pole section. The connector according to this invention includes an annular sleeve engageable about the outside of the new pole section. The sleeve projects beyond the new pole section and projecting beyond the new pole section to form a socket for receiving the distal section therein. The sleeve also has push plates engageable by means of bolts anchored in the sleeve to hold the distal section socketed in the sleeve. A suitable sealant, such as grout, is also employed.

The new pole section may have a length substantially the same as the proximal section of the existing utility pole, whereby the hardware will be restored to approximately its original elevation above the earth. Or the new pole section may have a different length from that of the proximal pole section, whereby the elevation of the hardware may be changed.

The proximal section may first be severed from the earth so as to leave a stump section protruding from the earth and so as to define a bottom end of the proximal section. Then the proximal section may be arranged vertically adjacent the stump section with the bottom end of the proximal section on the earth for supporting temporarily the distal section. During the severing of the distal section from the proximal section and the connecting of the distal section to the new pole section, the distal section is supported independently for example by means of a crane.

The new pole section can be of any otherwise suitable pole material (including but not necessarily limited to wood, steel, aluminum, prestressed or reinforced concrete or resin bonded glass fibers) as can be the existing pole (but which in most instances is made of wood). Preferably the new pole section is of prestressed concrete and formed hollow so that among other things a connecting line between a distal section and the earth may be provided therewithin. Hydraulic jacking is a convenient way of removing the stump section and the hole vacated thereby (with or without augering) is useful for implanting the new pole section therein.

Alternately the new pole section can be erected adjacent the old pole and, after severing the distal sections (with the hardware thereon) from the proximal section of the old pole, the distal section can be mounted on the new pole section. Thereafter the proximal section of the old pole can be removed.

Accordingly one object of this invention is to allow convenient, inexpensive, rapid and safe replacement of damaged or deteriorated utility poles.

Another object of this invention is to allow replacement of utility poles without having to rework hardware thereon and without interruption of service.

Still another object of this invention is to provide for convenient altering of the height and/or alignment of hardware on the utility pole.

Still another object of this invention is to accommodate use of a same or an otherwise suitable different material for new pole sections relative to the material of the existing pole.

Still another object of this invention is to allow for the proximal section of the existing pole first being severed from the earth, so as to leave a stump section protruding from the earth, and so as to define a bottom end of the proximal section. Then the proximal section may be arranged vertically adjacent the stump section with the bottom end of the proximal section on the earth for supporting temporarily the distal section.

Still another object of this invention is preferably to use new pole sections of prestressed concrete which are hollow and which can accommodate therewithin a connecting line between the distal section and the earth to provide positive grounding to the earth.

Still another object of this invention is to provide push plates engageable by means of screws to hold the distal sections socketed in an annular sleeve connected atop the new pole section.

BRIEF DESCRIPTION OF DRAWINGS

The foregoing and other objects, features and advantages will appear more fully from accompanying drawings, viewed in conjunction with a detailed description of preferred embodiments of the invention and viewed with claims which follow. In the drawings same numerals refer to like elements throughout and:

DESCRIPTION OF PREFERRED EMBODIMENTS

As taught in U.S. Pat. No. 3,911,548, and more particularly in FIGS. 1–8 thereof taken in sequential order, a method is illustrated for replacing a damaged or deteriorated utility pole having a proximal section attached to the earth and a distal section 14 having hardware 15 thereon and on which utility wires 16 are strung. Replacement of the pole does not require disturbing of the hardware 15 on the distal section 14 and replacement of the pole can be accomplished readily without any interruption of service, as described in U.S. Pat. No. 3,911,548.

Figure 2:
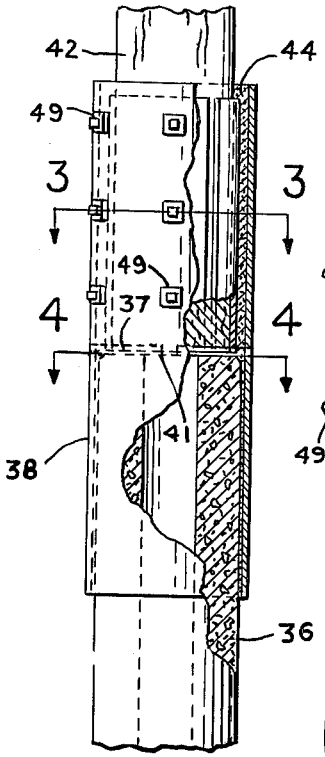
FIG. 2 is a partially broken sectional view of a first embodiment of a connector according to this invention.
Figure 3:
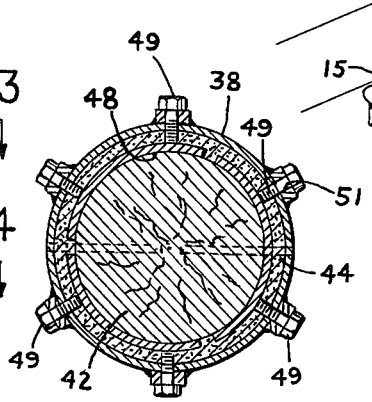
FIG. 3 is a sectional view taken along line 3—3 of FIG. 2.
Figure 4:
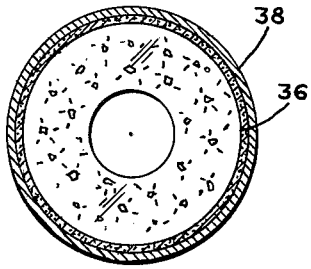
FIG. 4 is a sectional view taken along line 4—4 of FIG. 2.
Figure 1:
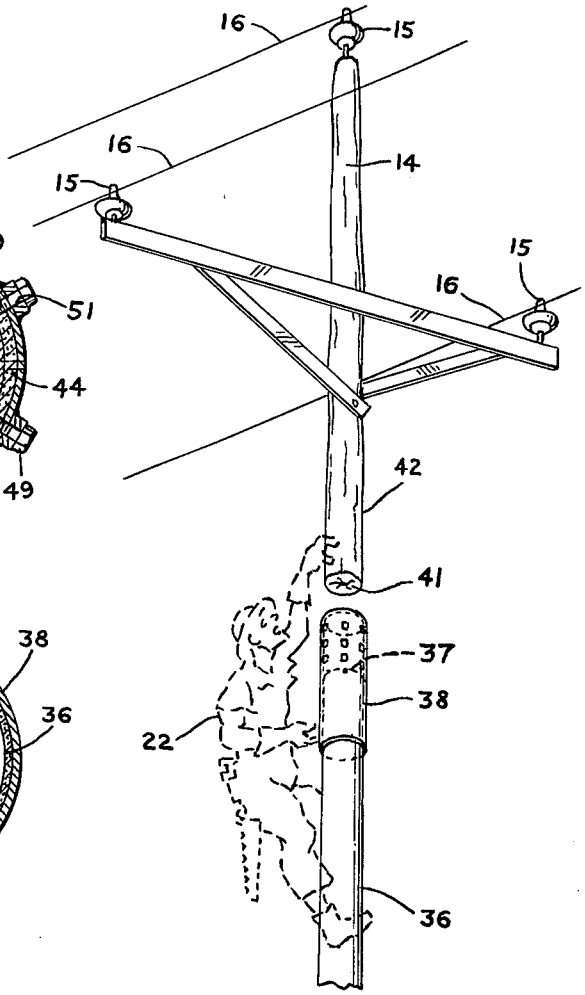
FIG. 1 is a schematic illustration (comparable to FIG. 6 in the parent application) of a distal section of a pole with its hardware intact thereon being inserted into a socket atop a new pole section. A truck boom (not shown) could be a means to accomplish this insertion.
Figure 6:
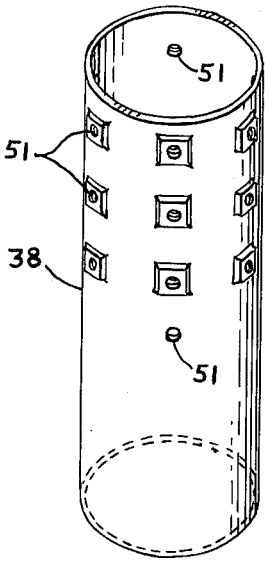
FIG. 6 is an isometric detailed view of the annular sleeve of the first embodiment.
Figure 7:
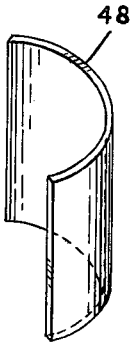
FIG. 7 is a detailed isolated view of a push plate according to this invention.
Figure 5:
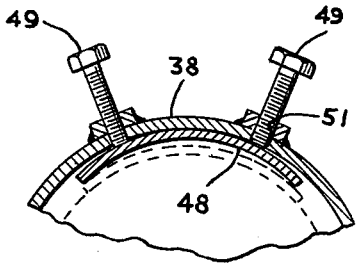
FIG. 5 is a partly broken sectional view showing the engaging means as bolts anchored in and engageable threadably through openings in the sleeve.

In accordance with the first embodiment of this invention, as seen best in FIG. 1, a new pole section 36 has a distal end 37 onto which is mounted a sleeve 38. The old pole section is severed at 41 and it has a proximal section 42 which is guided into the sleeve 38 by a workman 22. The workman 22 completes the connecting by tightening bolts 49 and filling the joint with a suitable sealant 44 such as grout. The workman 22 uses conventional means for supporting himself at the distal section 14. Push plates 48 serve as centering cuffs engageable by turning of the bolt 49 through threaded openings 51 in the annular sleeve 38.

Figure 8:
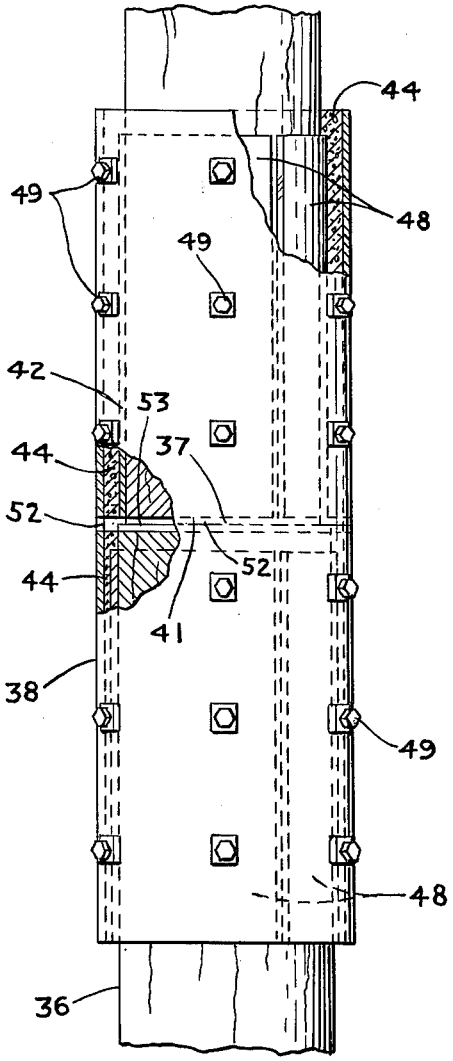
FIG. 8 is a partially broken sectional view comparable to FIG. 2 of a second embodiment of a connector according to this invention.
Figure 9:
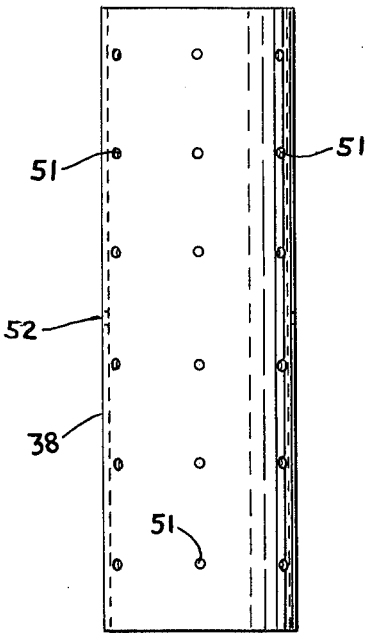
FIG. 9 is an elevational view of the second embodiment of the connector.

In accordance with the second embodiment of this invention shown in FIGS. 8 and 9, the new pole section 36 is made of wood and bolts 49 as well as push plates 48 are also provided for connection of the sleeve 38 to the wooden new pole section 36.

Weep holes 52 may be predrilled in the tube 38 at the elevation of the bottom of a wooden distal pole section. Rubber stoppers (not shown) are inserted into the holes to prevent the grout 44 from leaking therethrough. When the grout 44 is hard (say in 10 to 15 minutes), the rubber stoppers are removed and bores 53 are drilled into the bottom 42 of the wooden distal pole section. These weep holes allow water, that may intrude through checks in the wood, to drain out and thus deterioration is prevented.

It will be apparent to those skilled in manufacturing, erecting and repairing of utility poles that wide deviations may be made from the shown embodiments, without departing from a main theme of invention delineated in claims which follow.

I claim:

1. In combination a connector fixedly mounted on a cylindrical new prestressed concrete utility pole section, the connector and new pole section being joinable to a severed distal section of an erected generally cylindrical wooden utility pole, without disturbing hardware mounted on the erected pole section, with a lower end of the distal pole section positionable in axially aligned abutment on an upper end of the new pole section, the connector comprising:

a tubular sleeve having a distal sleeve end projecting beyond the prestressed concrete upper end of the new pole section to present a socket for receiving the lower end of the wooden distal pole section therein, a plurality of arcuate push plates in the socket and surrounding the lower end of the distal pole section, at least one bolt for each of the push plates with each of the bolts anchored in the distal end of the sleeve and threadably engaged therewith for moving its push plate into engagement with the distal pole section, and a sealant between the distal pole section and the connector.

2. The combination of claim 1 with the new pole section hollow.

3. The combination of claim 1 with the sealant being grout.

4. The combination of claim 1 with the connector provided with at least one weep hole.

5. In combination, a connector and a cylindrical new utility pole section for being joined to a severed distal section of an old cylindrical utility pole, without disturbing hardware mounted on the old distal pole section, with a lower end of the distal pole section in axially aligned abutment on an upper end of the new pole section, the connector comprising:

a tubular sleeve engageable about the upper end of the new pole section and having a distal sleeve end projecting beyond the upper end of the new pole section to present a socket for receiving the lower end of the distal pole section therein, a plurality of arcuate push plates in the socket and surrounding the lower end of the distal pole section, engagement means connected to the distal sleeve end for moving the push plates into engagement with the distal pole section, the new pole section made of wood, second arcuate push plates surrounding the new pole section, second engagement means connected to the sleeve for moving the second push plates into engagement with the new pole section, a sealant between the distal pole section and the connector.

6. The combination of claim 5 with the sealant being grout.

7. The combination of claim 5 with a sealant between the distal pole section and the connector as well as between the connector and the new pole section.

8. The combination of claim 7 with the sealant being grout.

9. In combination, a connector and a cylindrical new utility pole section for being joined to a severed distal section of an old cylindrical utility pole, without disturbing hardware mounted on the old distal pole section, with a lower end of the distal pole section in axially aligned abutment on an upper end of the new pole section, the connector comprising:

a tubular sleeve engageable about the upper end of the new pole section and having a distal sleeve end projecting beyond the upper end of the new pole section to present a socket for receiving the lower end of the distal pole section therein, a plurality of arcuate push plates in the socket and surrounding the lower end of the distal pole section, engagement means connected to the distal sleeve end for moving the push plate into engagement with the distal pole section, the distal section made of wood, the connector provided with at least one weep hole.

* * * * *